United States Patent [19]

Patel

[11] 4,118,527

[45] Oct. 3, 1978

[54] METALIFEROUS FLAME SPRAY MATERIAL FOR PRODUCING MACHINABLE COATINGS

[75] Inventor: Mahesh S. Patel, Albertson, N.Y.

[73] Assignee: Eutectic Corporation, Flushing, N.Y.

[21] Appl. No.: 785,224

[22] Filed: Apr. 6, 1977

Related U.S. Application Data

[62] Division of Ser. No. 706,136, Jul. 19, 1976, Pat. No. 4,039,318.

[51] Int. Cl.[2] ..... B05D 1/08

[52] U.S. Cl. ..... 427/423; 75/0.5 R; 75/0.5 AA; 75/0.5 BA; 427/190; 427/427; 428/678; 428/676; 428/677

[58] Field of Search ..... 427/427, 423, 190; 428/937, 678, 676, 677; 75/0.5 R, 0.5 AA, 0.5 BA

[56] References Cited

U.S. PATENT DOCUMENTS

| | | | |
|---|---|---|---|
| 3,304,604 | 2/1967 | Quaas | 29/527.3 |
| 3,322,515 | 5/1967 | Dittrich et al. | 428/570 X |
| 3,334,975 | 8/1967 | Quaas et al. | 75/252 X |
| 3,338,688 | 8/1967 | Longo | 428/467 X |
| 3,340,049 | 9/1967 | Quaas et al. | 75/0.5 R X |
| 3,372,066 | 3/1968 | Quaas | 148/26 X |
| 3,428,442 | 2/1969 | Yurasko | 427/423 X |
| 3,455,019 | 7/1969 | Quaas | 427/423 X |
| 3,523,569 | 8/1970 | Quaas | 427/427 X |
| 3,841,901 | 10/1974 | Novinski et al. | 428/467 X |
| 3,936,295 | 2/1976 | Cromwell et al. | 75/0.5 R |
| 4,013,453 | 3/1977 | Patel | 427/423 X |
| 4,031,278 | 6/1977 | Patel | 427/423 |
| 4,075,376 | 2/1978 | Jaeger | 427/34 |

*Primary Examiner*—Shrive P. Beck

[57] ABSTRACT

A method is provided for producing adherent metal coatings on metal substrates, such as ferrous metal substrates, e.g. steel, cast iron and other metal substrates said material comprising a plurality of ingredients physically combined in intimate contact with each other, each of said plurality of ingredients comprising by weight about 3% to 15% aluminum, about 2% to 15% of a refractory metal silicide and the balance essentially a metal selected from the group consisting of nickel-base, cobalt-base, iron-base and copper-base metals.

12 Claims, 2 Drawing Figures

METALIFEROUS FLAME SPRAY MATERIAL FOR PRODUCING MACHINABLE COATINGS

Figure 1:
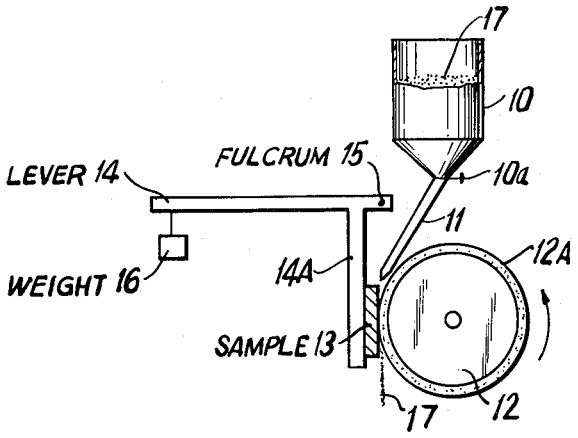

This is a division of copending application Ser. No. 706,136, filed July 19, 1976 now U.S. Pat. No. 4,039,318.

This invention relates to metaliferous flame spray materials and, in particular, to a metaliferous flame spray material formed of a plurality of ingredients or components comprising aluminum, a refractory metal silicide and an iron-group-base or copper-base metal physically combined together with each other.

STATE OF THE ART

It is known to coat metal substrates with a flame spray material having the property of protecting said metal substrates, such as a ferrous metal substrate, including steel and the like, and impart thereto improved properties, such as resistance to corrosion, and/or oxidation, and/or wear and the like. The metal sprayed may be in the form of a wire or a powder, powder spraying being a preferred method.

In order to provide a metal substrate with an adherent coating, it is the practice to clean the substrate, shot blast it with steel grit or thread the surface thereof on a lathe, if the shape is cylindrical, before depositing the metal coating thereon.

In U.S. Pat. No. 3,322,515, a method is disclosed for providing an adherent coating onto a metal substrate by first cleaning the substrate and flame spraying a bond coat using a flame spray powder in which elemental nickel and aluminum are combined together to form a composite. This type of powder which is referred to in the trade as bond coat powder provides a basis layer after spraying by means of which a sprayed overlayer of other metals and alloys of substantial thickness is adherently bonded to the metal substrate. With this technique, fairly thick overlayers can be produced.

The patent also states that ceramic deposits can be produced by mixing a ceramic with the nickel-aluminum composite powder, for example, 60% by weight of ceramic. Examples of ceramics are $Al_2O_3$ and carbides and silicides of Cr, Mo, W. and the like.

It is known that heated aluminum powder reacts easily with air to release a large amount of heat. It is believed that this mechanism is responsible in large part for the production of an adherent bond using nickel-aluminum powder. The bond coat generally ranges in thickness from about 0.004 to 0.01 inch, as thicker coatings do not have satisfactory properties.

For example, the nickel-aluminum bond coat per se has not been adequate as a final coat due to its poor machinability. Moreover, thick coatings of good quality are not obtainable, as the thicker the coating, the more powdery is the deposit. Such deposit is not conducive for providing a smooth surface finish by grinding or turning in a lathe and thus this method has not been useful as a one-step coating technique.

One proposal for overcoming the foregoing problem and provide a one-step bond coating is disclosed in U.S. Pat. No. 3,841,901. In this patent, it is proposed to add metallic molybdenum to the nickel-aluminum composite powder system or similar system (e.g. copper-aluminum, iron-aluminum or even the nickel-copper-aluminum system), the amount of aluminum ranging from about 2% to 18% and molybdenum from about 0.5 to 16% by weight. The patent states that the addition of molybdenum enables the production of a one-step nickel-aluminum-molybdenum coating of thickness, e.g. 0.03 to 0.05 inch, capable of providing a machined surface of good quality.

However, one of the disadvantages of using molybdenum is that, during flame spraying, molybdenum tends to produce smoke, especially in the upper range of composition.

It would be desirable to provide a one-step coating system capable of producing an adherent layer of substantial thickness, which can be machined to provide a good quality surface and which coating inherently exhibits resistance to wear, corrosion and oxidation. The term "machining" used herein is intended to cover grinding and surface cleaning using a cutting tool, such as turning on a lathe or other forms of machining, for example, milling.

OBJECTS OF THE INVENTION

It is thus an object of the invention to provide a method of producing a bond coat on a metal substrate capable of being machined to provide a good quality surface.

Another object is to provide a metaliferous flame spray material comprising a plurality of ingredients physically combined together in intimate contact with each other, each of said ingredients comprising aluminum, a metal silicide and the balance essentially a metal selected from the group consisting of iron-group-base and copper-base metals.

A further object is to provide a flame spray powder capable of producing a bond coat of substantial thickness on metal substrates, e.g. ferrous metal substrates, in a one-step spray application and which is capable of being machined to a high finish.

Figure 2:
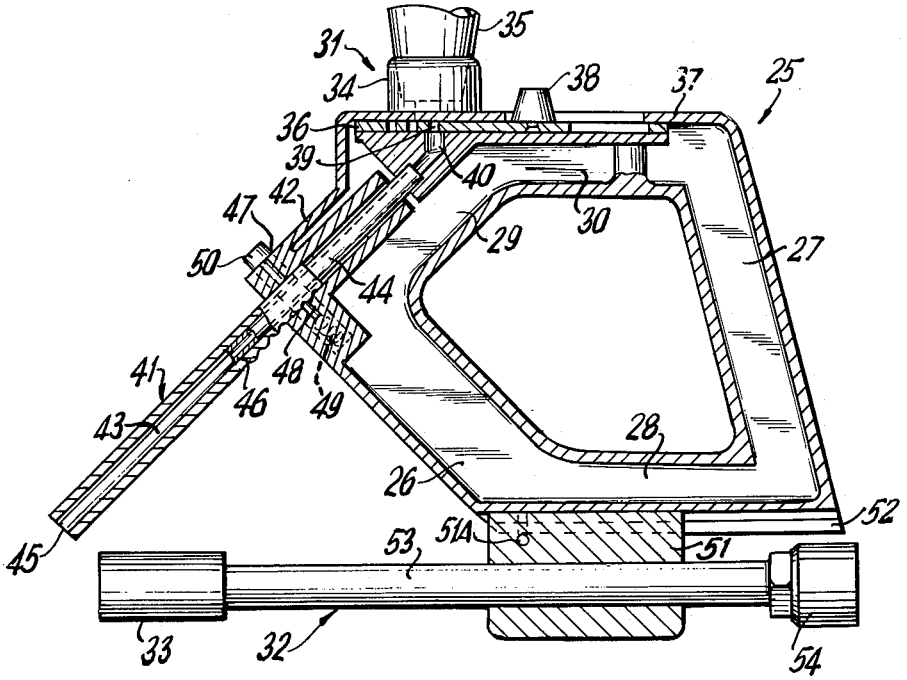

These and other objects will more clearly appear from the following disclosure and the accompanying drawing, wherein:

FIG. 1 is a schematic of a wear tester for determining the relative wear resistance of the coating produced by the invention; and FIG. 2 is an illustration of one type of torch which may be employed for spraying the material of the invention.

SUMMARY OF THE INVENTION

One embodiment of the invention is directed to a metaliferous flame spray material comprising a plurality of ingredients physically combined together in intimate contact with each other, each of said ingredients comprising by weight about 3% to 15% aluminum, about 2% to 15% of a refractory metal silicide and the balance essentially a metal selected from the group consisting of iron-group-base (e.g. nickel-base, cobalt-base and iron-base metals) and copper-base metals. The terms "nickel-base", "cobalt-base", "iron-base", and "copper-base" are meant to include alloys (i.e. at least 40% by weight of the metal), as well as nickel, cobalt, iron and copper per se. The refractory metal silicide is not employed to produce a ceramic as in U.S. Pat. No. 3,322,515 but, on the contrary, to provide a metal coating having improved machineability and improved bonding strength.

The metaliferous flame spray material may be in the form of a clad wire, for example, aluminum clad with nickel, the nickel surface being in turn coated with a resin having fine particles of the refractory metal silicide dispersed therethrough in an amount falling within the composition range stated hereinbefore. The wire may be an extruded plastic wire (e.g. polyethylene)

having the ingredients in powder form dispersed therethrough, the plastic decomposing during flame spraying using a conventional wire flame spray gun. Another type metal spray wire may comprise a nickel sheath filled with aluminum and refractory metal silicide powder, the ends being then closed and the sheath worked into the desired wire diameter by the usual well known methods, e.g. swaging, rolling, drawing and the like.

Preferably, the metaliferous flame spray material is used in the form of a powder, substantially each particle of which is an agglomerate of the ingredients physically combined in intimate contact with each other. Such agglomerates can be produced using a fugitive binding agent, e.g. a decomposable organic binding agent, such as a phenolic or other similar resins. Such resins adhesively bond the ingredients together.

Thus, a preferred embodiment of the invention is directed to a metaliferous flame spray powder comprising a mixture of ingredients in the form of free flowing agglomerates, the agglomerates having an average composition in which the ingredients range by weight from about 3% to 15% particulate aluminum, about 2 to 15% particulate refractory metal silicide and the balance essentially nickel-base, cobalt-base, iron-base and copper-base metals. The material when flame sprayed to provide a bonded coating on a metal substrate, e.g. a ferrous metal substrate, is characterized by improved machinability, improved bonding strength, and improved wear resistance as will be shown hereinafter.

Preferably the refractory metal silicides are selected from the group consisting of disilicides of Ti, Zr, Hf, V, Nb, Ta, Cr, Mo and W.

In producing the powdered agglomerates, it is preferred that the average particle size of aluminum powder and the refractory metal silicide powder not exceed about one-half, and more preferably, not exceed about one-fourth, of the average particle size of the metal powder selected from the group consisting of nickel-base, cobalt-base, iron-base and copper-base metals, these metals being hereinafter referred to as the "core metals". As stated earlier, these core metals include nickel, cobalt, iron and copper per se as well as nickel-base, cobalt-base, iron-base and copper-base alloys. The agglomerates generally comprise the aluminum and refractory metal silicide adhesively bonded to the core metal.

The preferred core alloys may comprise alloys containing self-fluxing alloying agents, such as silicon and/or boron. The self-fluxing agents may be present in the core metals in an amount ranging by weight from about 0.5% to 6% silicon and/or about 0.5% to 5% boron. Examples of such self-fluxing alloys are given hereinafter.

It is preferred that the aluminum content of the spray material range by weight from about 3% to 10% and the refractory metal silicide from about 2% to 10%, with the balance essentially the core metal.

The average size of the aluminum and silicide powder is preferably less than about 30 microns, the average size of the aluminum powder generally ranging from about 0.1 to 15, e.g. about 2 to 10, microns and the silicide powder from about 0.1 to 25, e.g. 0.1 to 10, microns.

The core powder may have an average size less than 140 mesh (U.S. Standard), for example, at least about 80% ranging from about minus 200 to plus 325 mesh, and when formed as an agglomerate with the other ingredients, the average size of the agglomerate preferably ranges from about minus 100 mesh to plus 325 mesh and, more preferably, from about minus 140 mesh to 325 mesh.

The powders may be sprayed using various types of metal spray torches well known in the art. As regards such torches, the powder formulation is injected into the stream of burning gas and emitted from the torch and applied to the metal substrate.

A preferred torch is that disclosed in U.S. Pat. No. 3,620,454 which is adapted for gravity feed of the powder externally to the flame issuing from a nozzle as shown in FIG. 2.

DETAILS OF THE INVENTION

Tests have shown that the addition of silicides to the nickel-aluminum system and other similar systems enables the production of coatings of good integrity in a one-step application of the coating material by flame spraying. Coatings of substantial thickness ranging up to about 0.25 inch can be produced in accordance with the invention, e.g. about 0.01 to 0.125 inch. It is believed that the silicides not only strengthen the structure of the coating but also impart improved resistance to oxidation and improved bonding strength, as well as improve the machinability of the coating.

In producing the agglomerate, the core metal, the aluminum and the refractory metal silicide powders are mixed in the proper amount with a resin bonding agent or adhesive, such as methyl methacrylate dissolved in methyl ethyl ketone. The amount of resin employed corresponds on a dry basis with respect to the total core metal plus aluminum plus refractory metal silicide content of about 2% to 3% by weight following evaporation of the solvent. Broadly speaking, the amount of resin on the dry basis may range from about 1% to 5% of the total weight of the ingredients being agglomerated.

Examples of resins which may be employed are the acrylates, e.g. methyl methacrylate, polyvinyl chloride, polyurethane, polyvinyl alcohol, isobutyl metacroid, and the like. The resins are employed as solutions, that is, dissolved in a compatible volatile organic solvent, such as alcohols, methyl ethyl ketone (MEK), xylol, and the like, and the solution in predetermined amounts mixed with the powdered ingredients and solvent evaporated to leave behind bonded agglomerates which are sized by passing the agglomerates through a screen of 100 mesh and preferably through 140 mesh.

APPLICATION OF THE COATING

While various flame spray torches may be employed for producing the coating on a metal substrate, a preferred torch is that shown in FIG. 2.

The flame spray torch 25 shown may be adapted for gravity feed of metal powder directly to the flame issuing from the nozzle as shown, or the powder feed may be automated by injection with a carrier gas under pressure (e.g., such as argon) from a powder feed unit.

The torch has a housing in the shape of a five-sided polygon with one leg of the polygon arranged as a handle portion 27, another leg as a base portion 28, a further leg as a feed portion 29, and another leg of the polygon as the top portion of the torch. The housing 26 has coupled to it a powder feed assembly 31 and a flame assembly 32 to which is coupled nozzle 33.

The top portion 30 is provided with a fitting 34 adapted to receive a receptacle 35 (shown fragmentarily) for holding the alloy powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The agglomerates flow by gravity unhindered through circular orifices which may range in size from 0.075 to 0.120 inch for different powders, the flow being maintained substantially constant over a mesh size range of minus 100 to plus 325 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43, the powder then flowing through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg of housing 26, a locking pin 51A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 43. The powder is sprayed on a metal substrate, e.g. a steel shaft, at about six to eight inches from the workpiece.

In a preferred embodiment of the invention, 6% aluminum, 4% chromium disilicide and 90% nickel were agglomerated using a phenolic resin (e.g. phenolformaldehyde) in a solvent (ethyl alcohol) as the bonding agent to provide, following drying at 350° F. (177° C.), a retained amount of about 3% resin by weight of said agglomerate. The average particle size of the nickel powder was about 60 microns, the aluminum powder about 5 microns and the disilicide about 5 microns. The resulting powder was screened to provide an average size of substantially about minus 140 to plus 325 mesh.

The powder was sprayed onto a smooth round 1020 steel shaft using a gravity feed torch of the type shown in FIG. 2. A very bright flame was produced and the resulting coating bonded to the shaft without difficulty to provide a one-step coating thickness of about 0.08 to 0.1 inch. This is a substantial thickness. The steel shaft was then dry machined using a carbide tip cutting tool while the shaft was rotated at 710 rpm (approximately 110 surface feet per minute). The deposit exhibited excellent machinability, the surface measuring about 25 micro-inches RMS (root mean square).

The bond strength of the deposit on the smooth steel surface measured 3500 to 3800 psi (lbs/in.$^2$). A powder composition comprising 6% aluminum, 4% titanium disilicide and 90% nickel also provided a coating of good quality which was machinable and exhibited a bond strength with respect to the steel surface of about 3900 to 4100 psi.

As illustrative of additional embodiments of the invention, the following example is given:

EXAMPLE 1

Tests were conducted using various refractory silicide additions to nickel and aluminum, each agglomerated composition being formed as previously described. About 4% by weight of refractory metal disilicide was blended with 6% aluminum, and 90% nickel using a fugitive resin binder of phenolformaldehyde. The nickel powder had an average particle size of about 60 microns with the aluminum powder about 5 microns and the disilicide about 5 microns.

The powders produced were flame sprayed onto 1020 steel and the bond strength of the coat and the machinability rating determined. The machinability rating was determined by machining the coating sprayed onto a steel shaft using a carbide tip cutting tool and the smoothness of surface measured in micro-inches (RMS). The following results were obtained using "S" alloy as a reference.

| No. | Composition | Bonding Str. (psi) | Machinability Rating |
|---|---|---|---|
| S | 7% Cr-15%-bal. Ni Alloy* | — | 50* |
| 1 | 6% Al-90% Ni-4% $MoSi_2$ | 3228 | 50 |
| 2 | 6% Al-90% Ni-4% $CrSi_2$ | 3480 | 65 |
| 3 | 6% Al-90% Ni-4% $WSi_2$ | 3618 | 55 |
| 4 | 6% Al-90% Ni-4% $TiSi_2$ | 4009 | 25 |
| 5 | 6% Al-90% Ni-4% $ZrSi_2$ | 2886 | 30 |
| 6 | 6% Al-90% Ni-4% $NbSi_2$ | 2312 | 25 |
| 7 | 6% Al-90% Ni-4% $TaSi_2$ | 2400 | 25 |
| 8 | 6% Al-90% Ni-4% $VSi_2$ | 2560 | 25 |
| A | 6% Al-94% Ni | 2375 | 20 |

*This coating is an Inconel-type alloy coating. A bond coat of Ni-Al (95% Ni-5% Al) is first sprayed followed by a spray coating of the alloy. This alloy is used as a standard machinability rating reference by comparing the other coatings to it, the allow rating being 50.

The bond strength is determined by using a plurality of sets of two cylindrical blocks one inch in diameter and one inch long. An end face of each block of the set is ground smooth and one face coated with the aforementioned bond coat compositions by flame spraying to a thickness of about 0.01 inch. A high strength overcoat is applied to the bond coat, the high strength overcoat being the Inconel-type alloy shown as Alloy No. "S" in the table which has a bond strength of over 10,000 psi, that is, much higher than the bond coat being tested. The thickness of the high strength overcoat is about 0.015 inch and after depositing it, it is finished ground to 0.01 inch. A layer of epoxy resin is applied to the overcoat layer, the epoxy layer having a bond strength of over 10,000 psi.

The other block of the set is similarly end ground and a layer of high strength epoxy resin applied to it. The two blocks of the set, one with the metal coating and the epoxy layer is clamped to the other with the epoxy faces of the blocks in abutting contact and the clamped blocks of each set subjected to heating in an oven to 300° F. (150° C.) for one hour, whereby the epoxy faces strongly adhere one to the other to provide a strongly bonded joint.

The joined blocks are then pulled apart using anchoring bolts coaxially mounted on opposite ends of the joined block using a tensile testing machine for recording the breaking force. The bonding strength is then determined by dividing the force obtained at failure by the area of the one inch circular face of the blocks.

As will be noted from the table, systems No. 1 to No. 8 in general showed good bonding strengths relative to the nickel-aluminum system A. The disilicides of chromium, tungsten and titanium gave consistently high bonding strengths. While some of the bonding strengths were close to the Ni—Al system, the coating quality was better.

Test Nos. 1 to 6 were run in duplicate, while only one test specimen was used for tests No. 7 and No. 8. Test A is based on an average of two tests.

The quality of machinability is determined by comparing the appearance of the surface of the invention with the standard "S" specimen which has a reference rating of 50, the machining being carried out dry with a carbide tip cutting tool.

As will be noted, test "A" (the Ni—Al system) has a rating of 20 compared to 50 for the standard "S". The others (Tests No. 1 to No. 8) show a rating of 25 to as high as 65 which is a noticeable improvement over the Ni—Al system (A). The system of the invention with $CrSi_2$, $MoSi_2$, and $WSi_2$ gave consistently high machinability ratings of 50 to 65 relative to standard "S".

WEAR TESTING

A wear test was conducted on the system Ni—Al—$CrSi_2$ which was compared to the wear characteristics of the Ni—Al system. The wear testing device is illustrated schematically in FIG. 1 and comprises a lever 14 having two legs at right angles to each other, one of the legs 14A carrying a sample which bears against a rotating wheel 12 as shown, the lever being pivotally mounted at fulcrum 15.

The free end of lever arm 14 supports a weight 16 which is located sixteen inches from the pivot end thereof for applying pressure to sample 13 in contact with the periphery of rubber wheel 12A.

The hopper contains hard particles of material, e.g. silica ($SiO_2$) or silicon carbide (SiC) and the like which are fed via the opening of gate 10A down chute 11 which is inclined relative to the horizontal axis of the lever arm and extends to the surface of the sample and is adapted to feed a steady flow of hard particles to said sample 13 mounted on leg 14A in tangential contact with rubber wheel 12A by virtue of weight 16, the hard particles being fed into the bite formed between the contacting surfaces of the sample and the wheel, the hard particles 17 being shown emitting downwardly therefrom after passing through the bite area in frictional contact with the surface of the sample. The following conditions were employed in the tests.

| | |
|---|---|
| Abrasive Employed: | −20 +40 mesh sand |
| Test Time: | 15 minutes |
| Flow Rate of Sand: | 1 lb/min. |
| Method: | The abrasives are carried to the specimen by the rubber heel. The specimen is pressurized against the abrasive on the wheel with a fixed load of 12 lbs. |

The following results were obtained:

| | 94% Ni-6% Al | | 94% Ni-6% Al-4% $CrSi_2$ | |
|---|---|---|---|---|
| | Test 1 | Test 2 | Test 1 | Test 2 |
| Loss in Weight (grs) | 1.22 | 1.62 | 0.58 | 0.59 |
| Wear Factor | 7.3 | 5.5 | 15.30 | 15.00 |

The wear factor is determined as the reciprocal of the volume loss of the coating during testing, the loss in weight (grs.) being converted to cubic centimeters.

As will be noted, the wear factor of the coating of the invention is improved by two or three times over the wear of the 94% Ni-6% Al coating system. In other words, the higher the wear factor value, the greater is the wear resistance of the coating being tested.

A microscopic examination of the coating showed an excellent bond. With regard to nickel-base coatings, an iron-nickel solid solution was noted at the interface. It is apparent that the presence of chromium silicide markedly strengthens the deposited coating.

A Knoop microhardness reading of the phases in the coating using a 50 gram load showed the nickel matrix to have a hardness of 206, an average of ten readings being used ($KHN_{50}$). The chromium silicide in the coating exhibited a $KHN_{50}$ reading of 850 (average of ten readings). The average gross hardness of the as-sprayed coating using a standard Rockwell B hardness tester was about R*b* 65 to 70.

As stated hereinbefore, the invention is also applicable to nickel-base, cobalt-base, iron-base and copper-base alloys as well as to nickel, cobalt, iron and copper per se.

The preferred alloys are those which are self-fluxing and have a melting point ranging from about 870° C. to 1288° C. (1600° F. to 2350° F.), it being understood that the alloys need not be self-fluxing. The self-fluxing alloys include those containing at least one of the metals selected from the group consisting of about 0.5% to 6% of silicon and 0.5% to 5% boron.

Examples of such alloys are given as follows:

NICKEL-BASE MATRIX ALLOY

| Constituent | Range in Percent by Weight | Example |
|---|---|---|
| Silicon | 1.5 - 5.0 | 3.0 |
| Boron | 1.5 - 5.0 | 2.0 |
| Chromium | 0 - 20 | 1.0 |
| Molybdenum | 0 - 7 | 0.2 |
| Nickel | (1) | (1) |

(1) Essentially the balance.

The above alloy may be substituted in nickel content by cobalt or iron. Also, alloys of this type can consist as a matrix containing refractory carbide particles (e.g. WC) in a fine particle size to effect a further improvement in abrasion resistance. The following matrix alloy may be employed.

COBALT-BASE MATRIX ALLOY

| Constituent | Range in Percent by Weight | Example |
|---|---|---|
| Nickel | 1.0–5.0 | 3.0 |
| Chromium | 20.0–32.0 | 28.0 |
| Silicon | 0.5–3.0 | 1.0 |
| Boron | 1.0–3.0 | 2.0 |
| Carbon | 0.8–2.0 | 1.0 |
| Tungsten | 3.5–7.5 | 4.5 |
| Molybdenum | 0.0–0.5 | 3.0 |
| Cobalt | (1) | 57.5 |

(1) Essentially the balance.

Again, nickel or iron may be substituted in the above formulation for a like amount of cobalt.

A particularly preferred copper-base matrix alloy which has been found useful has the following constituents in percentages by weight as indicated:

| COPPER-BASE ALLOY | | |
|---|---|---|
| Constituent | Broad Range | Intermediate Range |
| Nickel | 15.0 - 40.0 | 20 - 25 |
| Silicon | 1.0 - 5.0 | 3.0 - 4.0 |
| Boron | 0.15 - 2.50 | 0.25 - 0.5 |
| Manganese | 0.20 - 2.00 | 0.5 - 1.0 |
| Copper | (1) | (1) |

(1) Essentially the Balance

As an example of a matrix alloy within the above ranges, there may be mentioned:

| Constituents | Percent by Weight |
|---|---|
| Nickel | 23.00 |
| Silicon | 3.45 |
| Boron | 0.47 |
| Manganese | 0.75 |
| Copper | (1) |

(1) Essentially the balance

The foregoing alloys are preferably employed as atomized powders. A particular nickel-base alloy is one containing about 3% Si, 2% B, 1% Cr, 0.2% Mo and the balance essentially nickel.

The foregoing alloy powder (about 90% by weight) of about 60 to 75 microns in average size is agglomerated, using the phenolic resin (phenolformaldehyde) as the binding agent, with 4% $TiSi_2$ and 6% Al of average size of about 4 to 6 microns to provide a flame spray powder, after screening, of average size of about minus 140 mesh to plus 325 mesh. This powder when flame sprayed using a gravity fed torch of the type shown in FIG. 2 produces a strongly adherent coating on a variety of metal substrates, such as ferrous substrates, e.g. steel, cast iron, and the like.

As stated hereinbefore, as-sprayed coatings of substantial thickness may be produced in accordance with the invention, e.g. coating thicknesses of up to about 0.25 inch, e.g. about 0.01 to 0.125 inch. The fact that disilicides may be employed to produce the coating does not mean that only disilicides will be present. For example, the spraying of powder containing $TiSi_2$ has resulted in a coating with TiSi, $Ti_5Si_3$, etc., being present. Likewise, a powder containing $CrSi_2$ has resulted in a coating containing CrSi. Generally speaking, the final coating will contain less than 15% by weight of refractory metal silicide (e.g. silicides of Ti, Zr, Hf, V, Nb, Ta, Cr, Mo and W) and generally less than about 10% by weight.

While the sprayed metal coating of the invention has shown particular applicability to ferrous metal substrates, the sprayed metal coating is also compatible with metal substrates comprising nickel, cobalt, aluminum-base alloys and copper substrates, among other compatible metal substrates.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What I claim is:

1. A method of producing an adherent bond coat on a metal substrate which comprises:

flame spraying onto said metal substrate a metaliferous flame spray material comprising a plurality of ingredients physically combined together with each other, said plurality of ingredients comprising by weight about 3% to 15% aluminum, about 2% to 15% refractory metal silicide and the balance essentially a metal selected from the group consisting of nickel-base, cobalt-base, iron-base and copper-base metals, and continuing said spraying to form an adherent bond coat on said substrate characterized by improved machinability, improved bonding strength and improved resistance to wear.

2. The method of claim 1, wherein said refractory metal silicide is selected from the group consisting of disilicides of Ti, Zr, Hf, V, Nb, Ta, Cr, Mo and W.

3. The method of claim 2, wherein the amount of aluminum ranges from about 3% to 10% and the amount of disilicide ranges from about 2% to 10%.

4. The method of claim 3, wherein the refractory metal disilicide is chromium disilicide and the metal making up essentially the balance is a nickel-base metal.

5. The method of claim 3, wherein the refractory metal disilicide is titanium disilicide and the metal making up essentially the balance is a nickel-base metal.

6. A method of producing an adherent bond coat on a metal substrate which comprises:

flame spraying onto said metal substrate a flame spray powder in the form of agglomerates comprising a plurality of ingredients physically combined together with each other, said agglomerates having an average composition comprising ingredients ranging by weight from about 3% to 15% aluminum, about 2% to 15% refractory metal silicide and the balance essentially a metal selected from the group consisting of nickel-base, cobalt-base, iron-base and copper-base metals, and continuing said spraying to form an adherent bond coat on said substrate characterized by improved machinability, improved bonding strength and improved resistance to wear.

7. A method of producing an adherent bond coat in a metal substrate which comprises:

flame spraying onto said metal substrate a flame spray powder in the form of agglomerates comprising a plurality of ingredients physically combined with each other, said agglomerates having an average composition comprising said ingredients ranging by weight from about 3% to 15% particulate aluminum, about 2% to 15% of particulate refractory metal disilicide selected from the group consisting of disilicides of Ti, Zr, Hf, V, Nb, Ta, Cr, Mo and W, and the balance essentially a core metal powder selected from the group consisting of nickel-base, cobalt-base, iron-base and copper-base metals, and continuing said spraying to form an adherent bond coat on said substrate characterized by improved machinability, improved bonding strength and improved resistance to wear.

8. The method of claim 7, wherein said agglomerates have an average particle size falling substantially within the range of minus 100 mesh and plus 325 mesh, the core metal being at least about 80% ranging from about minus 300 to plus 325 mesh, the aluminum and disilicide powder being less than about 30 microns in average size.

9. The method of claim 7, wherein the core metal is a self-fluxing alloy containing at least one metal selected from the group consisting of 0.5% to 6% silicon and 0.5% to 5% boron.

10. The method of claim 9, wherein the core metal is a nickel-base metal.

11. The method of claim 10, wherein the refractory metal disilicide is chromium disilicide.

12. The method of claim 10, wherein the refractory metal disilicide is titanium disilicide.

* * * * *